United States Patent [19]

Ruppert et al.

[11] Patent Number: 4,614,519

[45] Date of Patent: Sep. 30, 1986

[54] SOIL RELEASE AGENT FOR TEXTILES

[75] Inventors: Ronald M. Ruppert, Moonachie; Lenore E. Savio, West Milford, both of N.J.

[73] Assignee: GAF Corporation, Wayne, N.J.

[21] Appl. No.: 669,567

[22] Filed: Nov. 8, 1984

[51] Int. Cl.[4] ..... B08B 3/04

[52] U.S. Cl. ..... 8/137; 252/174.23

[58] Field of Search ..... 252/174.23; 8/137

[56] References Cited

U.S. PATENT DOCUMENTS

| | | | |
|---|---|---|---|
| 4,088,610 | 5/1978 | Bevan et al. | 252/8.9 |
| 4,138,352 | 2/1979 | Teot et al. | 252/135 |
| 4,240,918 | 12/1980 | Lagasse et al. | 252/174.23 |
| 4,444,561 | 4/1984 | Denzinger | 252/174.23 |

*Primary Examiner*—Paul Lieberman
*Assistant Examiner*—John F. McNally
*Attorney, Agent, or Firm*—Marilyn J. Maue; Joshua J. Ward

[57] ABSTRACT

A soil release agent for coating synthetic and natural fibers and process of treating textiles to impart soil release properties thereto, said agent comprising a vinyl caprolactam resin.

9 Claims, No Drawings

SOIL RELEASE AGENT FOR TEXTILES

It is known that textiles and fibers derived from various synthetic fibers inherently tend to be hydrophobic and readily accumulate soil of a fatty, greasy or oily nature which is difficult to remove. It is therefore desirable to modify the textile or fiber surface so as to render it more hydrophilic and consequently resistant to soiling with oil, grease or fatty type agents. While textiles derived from cellulosic and other natural occuring fibers are not inherently hydrophobic, they are often rendered so by treatment with various finishing agents, e.g. durable press resins. To overcome the tendency for oil and grease soil penetration, thin films of modified cellulose ethers have been employed to coat the fabric surface and render it less oleophilic. Deposition of such films can be achieved by deposition onto the fabric from a laundry detergent or the cellulose ether can be directly padded, and optionally cured, on the surface of the textile for which anti-soiling properties are desired. Generally, soil resistance is more enduring when the anti-soiling film is cured on the fabric.

While the modified cellulose ethers are capable of improving soil resistance, they are not particularly effective at low temperatures often encountered in a normal laundry wash cycle. More specifically, the cloud point of the cellulose ethers is generally quite high, from about 110° F. to about 120° F. and the resin requires a temperature of from about 120° F. to about 140° F. for solubilization in the coating medium, e.g. an aqueous detergent composition or a padding bath.

It is an object of the present invention to provide an improved coating resin which acts as a soil barrier against oily, greasy or fatty soiling agents.

Another object of the invention is to provide a resin which is readily exhausted from a dilute aqueous solution onto the surface of a fabric at a relatively low temperature.

Another object of the invention is to provide soil resistant textiles by means of treatment with a soil release agent of the present invention.

Still another object of this invention is to render a polyester fabric more receptive to cotton brighteners by modifying the polyester surface with a film of the resin of the present invention.

These and other objects and advantages of this invention will become apparent from the following description and disclosure.

According to this invention, there is provided an anti-soiling agent for fibers and textiles which comprises a polymer of N-vinylcaprolactam, preferably N-vinyl-e-caprolactam (VCL). These polymers include N-vinylcaprolactam homopolymer and its copolymers or terpolymers with minor aamounts of at least one of N-vinylpyrrolidone (VP), an ammonium derivative monomer of 6–12 carbon atoms of the group: dialkylaminoalkyl-acrylamide, -methacrylamide, -acrylate or -methacrylate and dialkyl dialkenyl ammonium halide and stearyl-acrylate or -methacrylate. The vinylcaprolactam polymer is utilized in the form of a resinous substance which may also include mixtures of the vinylcaprolactam polymer with other soil release agents. In cases where the vinylcaprolactam is composed of more than one monomer, those polymers containing between about 65 and about 95 wt % N-vinyl-e-caprolactam; between about 5 and about 35 wt % N-vinyl-2-pyrrolidone and optionally 0 to about 10 wt % dimethylaminoethyl methacrylate (DMAEMA), are most preferred. Specific examples of some preferred anti-soiling resins include:

80 wt % VCL/20 wt % VP
70 wt % VCL/30 wt % VP
65 wt % VCL/30 wt % VP/5 wt % DMAEMA
80 wt % VCL/15 wt % VP/5 wt % DMAEMA
VCL homopolymer The present VCL polymers are useful over a wide molecular weight range, e.g. a number average molecular weight of from about 1,000 to about 1,000,000, depending upon the particular monomer content and the flexibility required for a given application. For example, the degree of flexibility needed for upholstery is far less than is required for clothing fabric; accordingly the former can utilize or tolerate a film of a less flexible polymer or a thicker coating of the anti-soiling agent.

The vinyl caprolactam polymers of this invention are known, as are their methods of preparation which are disclosed in U.S. Pat. Nos. 2,806,848; 4,057,533; and in co-pending patent application Ser. No. 440,648, filed Nov. 10, 1982, now U.S. Pat. No. 4,521,404.

In general, the copolymers are conveniently prepared by subjecting the above monomers, either in admixture or added sequentially into a reactor, to a temperature of between about 40° C. and about 120° C. under from about 10 psig. to about 150 psig. for a period of from about 0.5 to about 10 hours in the presence of a free radical polymerization catalyst, such as organic and inorganic peroxides, e.g. hydrogen peroxide, t-butyl peroxide or an azo compound e.g. azobisisobutyronitrile, 2,2'-azobis-(2,4-dimethyl valeronitrile) etc. The polymerization is beneficially effected with agitation in solution, suspension or emulsion wherein the reaction medium is alcohol, benzene, hexane, water or any mixture thereof. The polymeric product is separated and recovered by precipitation and filtration, distillation, decantation, evaporation of solvent or any other conventional method. The vinyl caprolactam homopolymer can be prepared similarly; however, it is to be understood that other conventional methods of polymerization can be employed to provide the anti-soiling resins of the present invention.

The present anti-soiling resins can be employed in the absence of other anti-soiling agents; however, blending of the vinyl caprolactam homopolymer or terpolymer with conventional anti-soil agents is also beneficial. The presence of a vinyl caprolactam polymer significantly improves the properties of the conventional agents with which vinyl caprolactam is compatible. Particularly, cloud point, textile substantivity, prolonging activity of anti-soiling properties through several wash cycles etc. are improved. Conventional anti-soiling resins with which the present polymers are compatible are organic agents and include modified cellulose ethers as shown in U.S. Pat. Nos. 4,100,094, 4,379,061 and 4,441,881, hydroxyl terminated polyurethanes as disclosed in U.S. Pat. No. 3,660,010, the polycarboxylate polymer mixtures of U.S. Pat. No. 3,836,496, the polymers of vinylidene ester/unsaturated acids or anhydrides of U.S. Pat. No. 3,563,795, fluorocarbon polymers disclosed in U.S. Pat. No. 3,598,515 and the like. Of these supplementary anti-soiling agents, modified cellulose ethers, e.g. hydroxyalkyl alkyl cellulose ethers are preferred. Illustrative examples of such ethers include those wherein the alkyl groups have between 1 and 6 carbon atoms, e.g. hydroxypropyl methyl cellulose ether, methyl cellulose ether, hydroxybutyl methyl cellulose ether, etc. One or more properties of the above conventional soil release agents can be improved with incorporation of as little as 2.5 wt % of the present vinylcaprolactam resin. For example, the non-permanency of the polycarboxylate polymers can be significantly increased to withstand several wash cycles. However, since the soil release finish can be applied with each laundering, the soil release effect at its original strength can be constantly renewed. In general, for improvement over prior art soil release barriers, the composition of the present invention may contaih from 0 to about 95% by weight of at least one of the above conventional anti-soiling agents; however where utilization of a blend is desired, from about 60/40 to about 40/60 part blends of vinyl caprolactam homopolymer or terpolymer/conventional anti-soiling agent is recommended.

The polymers of the present invention form a hydrophilic film or layer on the fibers or textile which, upon drying, affords soil releasability to the protected area. Each subsequent coating serves to enhance the soil-release characteristics of the fabric substrate.

The soil-release properties of pure cellulosic fiber or fabrics are much better than those of synthetics, e.g., polyester fibers, in that the synthetic polyester fibers are hydrophobic and thus prevent the ingress of water that is necessary for cleaning the fabric. Also, these fibers or fabrics possess an electrical charge that attracts soil particles. Treatment with the present resins not only alters the hydrophobic textile surface but also reduces the tendency to exert a static electrical charge.

The anti-soiling agents of the present invention may be used to treat a wide variety of textile materials made exclusively from synthetic polymer materials as well as blends of natural and synthetic fibers and also natural fibers rendered hydrophobic by finishing agents. Examples of synthetic fibers which may be successfully employed in the practice of the present invention include those made with polyamide, acrylic, polyolefin and polyester fibers, such as Nylon or Acrilan and an acrylonitrile such as Orlon. Blends of natural and synthetic fibers which may be successfully treated with the resins of the present invention include fabrics containing 50% polyester/50% cotton, 65% polyester/35% cotton, etc. Cellulose fibers such as viscose, regenerated cellulose, etc., also may be combined with cellulosic fibers. The resins of the present invention are most effective on fabrics of pure polyester and blends of polyester and cotton with a permanent press finish; although they may also be applied to natural fibers such as linen, wool, cotton and silk, if desired.

The above fabrics and fibers achieve soil resistance by coating or filming with the present resin. The resin coating of the present invention can be achieved in any convenient manner. For example, an aqueous solution wherein the concentration of the present resin may vary between about 0.01 wt % and about 20 wt can be padded on the surface of a fabric or fibers, or the textile can be dipped in said solution, to acquire a surface film of the anti-soiling agent. Alternatively, the resin solution can be sprayed on the textile surface. These operations can be repeated as many times as desired to achieve a thickness consistent with the ultimate use of the product. Generally such padding, dipping or spraying is accomplished at a temperature between about 27° C. and about 85° C. The coated material can be dried as the final product or it can be subjected to further treatment, such as cross-linking with a polyfunctional cross-linking resin or curing of the deposited coating at a somewhat higher temperature, e.g. 100° C., for more permanent soil resistance.

Polymeric textile fibers having available hydroxy groups can be provided with a durable soil release finish by cross-linking with polyfunctional agents capable of bonding hydroxy groups of the textile polymer and carbonyl groups of the vinylcaprolactam polymer. Suitable cross-linking agents include ethylene ureas, N-methylol acrylamide, halotriazones, haloacetamides, etc.

In practicing the process of the present invention as it concerns coating a fabric by padding, optionally followed by curing the vinylcaprolactam polymer coating to provide a soil release permanent press finish, the textile substrate can be padded with an aqueous composition comprising from about 2–20% by weight of a durable press resin, from about 0.1–15% by weight of the present vinyl caprolactam soil release agent composition, and from about 0.1–20% acid catalyst and other textile adjuvants as may be desired. The treated textile substrate is then passed through squeeze rollers set at about 30–50 lbs./sq. inch so that the desired "add-on" of each component (based upon the weight of the substrate) is present upon drying. The substrate is then dried at from about 65° C. to about 130° C., preferably from about 85° C. to about 90° C., until a noisture content of from about 2 to 11% by weight is obtained. The substrate is then pressed and cured using the conditions commonly employed in producing creased durable-press garments.

While it is convenient to apply all the components of the padding bath simultaneously, the components can be applied separately or in more than one bath.

The various modifiers, agents, conditioners and acids which alter characteristics other than durable press and stain release of the finished textile products are generically categorized as textile adjuvants. These adjuvants include softeners, surfactants, hand modifiers, antistatics, thickeners and the like. Illustrative of these are polyvinyl acetates of various average molecular weight ranges, thickeners such as the natural gums, ethylated starches, hydroxyethylcellulose and sodium carboxymethylcellulose, among others. Also intended to be included as adjuvants are the various wetting agents and other surfactants such as p-(1,1,3,3-tetramethylbutyl)-phenoxynona(ethyleneoxy)-ethanol, the sodium salt of N-methyl-N-oleyltaurine, and the sodium salts of sulfonated hydrocarbons, among others. Since the role of the textile adjuvants is not critical to the inventive process and since such adjuvants are well known, no attempt has been made to present an exhaustive or even lengthy list.

The polymeric vinyl caprolactam textile treating compositions can be in the form of a solution where the solubility characteristics allow it, or in the form of an emulsion or dispersion where certain adjuvants have limited water solubility.

The concentrations of the treating agents employed are varied to some extent according to the effect sought, the type of substrate, and the weight of the substrate. The following data show the ranges of components to be added in terms of parts by weight per 100 parts by weight of original fabric (this basis for indicating the weight of finish component added being hereinafter referred to as "Percent Solids OWF").

| Component | Percent solids OWF Suitable range | Preferred range |
|---|---|---|
| VCL polymer | 0.1–15 | 0.15–10 |
| Durable-press resin precursor | 3.0–20 | 5.0–10 |
| Acid catalyst | 0.1–20 | 0.2–6 |

The particular heating temperatures and the length of the heating cycle are not critical as long as the combination of heating temperature and time is sufficient to accomplish the drying, setting of configuration or curing of the durable-press resin precursor, etc. For example, after application of the soil-release agent the treated textile article can be dried up to the curing temperature of the resin precursor.

Similarly, the setting of the crease or pleat can be accomplished using different combinations of temperature, time and pressure. For instance, the treated fabric after being made into a garment can be pressed on an electrically heated hot-head garment press as follows: Steam is used for the first 5 seconds (at 150° to 160° C.), then the temperature is raised between about 160° C. to 250° C., keeping the head pressure at about 85–100 pounds/sq. inch. After the final heating, vacuum is applied for from about 3 to 15 seconds or higher to complete the pressing operation. Curing is accomplished by heating between about 130° C. to about 200° C.

It is to be understood that other known methods of padding and curing a soil resistant coating on a textile substrate are also included within the scope of this invention.

Still another convenient method of providing soil resistant textiles involves mixing the vinyl caprolactam resin a vinyl caprolactam resin mixture into a dry or liquid laundry detergent or laundry rinse formulation, after which an aqueous detergent or rinse solution containing the present resin in the above concentration range, is formed. The fabric is then introduced into the solution and washed or rinsed at a temperature above the resin cloud point whereupon the resin, having greater affinity for the fabric, precipitates out of solution and exhausts onto the surface of the fabric as an oil resistant shield or coating which guards against future soiling with oily materials. Since the present resin is more hydrophilic than the textile, and since it possesses limited solubility in aqueous solutions under laundering conditions, it is readily exhausted onto the surface of the fabric where it is allowed to dry to an oil resistant barrier. The resin may also be deposited on the fabric surface by means of a finishing spray after the clothes are laundered and are either damp or dry. In these applications, the resin of the present invention also provides brightening effects for the fabrics so treated.

The types of detergent compatible with the present resin include compositions containing one or more anionic, nonionic, amphoteric or zwitterionic detergent-active compounds or mixtures thereof, and generally builder salts. The detergent compositions specifically disclosed in U.S. Pat. No. 4,379,061 at columns 2–4, are suitably employed with the resins of this invention. Of these, non-phosphate, non-ionic and anionic detergents are most preferred.

To form the present detergent compositions, the soil resistant resin of the invention is added to the dry detergent powder or detergent solution in the desired concentration and the temperature and pH adjusted so that the resin is in a solution phase at the start of the washing cycle. Generally, a pH of between about 6 and about 13.5 and a temperature above the resin cloud point, e.g. between about 30° C. and about 50° C. is recommended for the beginning of the washing operation. As the washing temperature is raised to and above the resin cloud point, the resin precipitates from the solution phase onto the surface of the fabric thus forming a soil-resistant barrier thereon.

Having generally described the invention reference is now had to the following examples which set forth preferred embodiments of the invention. It is to be understood, however, that the scope of the invention embraces many modifications and variations which will become apparent from the foregoing description and disclosure and from the embodiments provided by the Examples.

EXAMPLES 1–5

The present vinyl caprolactam homopolymer and vinyl-e-caprolactam copolymers, in the proportions noted below were prepared by introducing a 4.5% ethanol solution of the monomers in the indicated proportions into a one liter, 4-neck round bottom glass flask which contains 0.04% of VAZO 52 (2,2'-azobis (2,4-dimethylpentane nitrile) as a catalyst. The reaction mixtures were stirred to maintain homogeneous conditions and polymerization was carried out under atmospheric pressure over a period of 12 hours with addition of catalyst to maintain 0.03% concentration. The reactions were initiated and allowed to run for the first 6 hours at 50° C., after which time the temperature was raised to 80° C. for the remaining 6 hours. In all cases the resinous products were obtained in at least 98% yield. The products were recovered and 0.25% aqueous solutions were prepared. These solutions, simulating dilution in a washing or laundering operation, were tested for clear/cloud point. The results of these tests, along with a leading soil release agent, METHOCEL, are reported as follows.

| EXAMPLE | VCPL RESIN | CLEAR/CLOUD POINT OF PRODUCT SOLUTION |
|---|---|---|
| 1 | VCPL/VP/DMAEMA (80/15/5) | 35–37° C. |
| 2 | VCPL/VP/DMAEMA (60/35/5) | 42–44° C. |
| 3 | VCPL/VP/DMAEMA (47.5/47.5/5) | 47–51° C. |
| 4 | VCPL/VP/DMAEMA (71/24/5) | 37–40° C. |
| 5 | VCPL homopolymer | 33° C. |
| METHOCEL E4M (Supplied by Dow Chemical Co.) | | 58–61° C. |

EXAMPLE 6

The product of Example 1 was mixed with hydroxypropyl methyl cellulose (METHOCEL E4M) to form a 50/50 resinous mixture. A 0.25% aqueous solution of this product was found to have a clear/cloud point of 36°–39° C. It was unexpected to find that dilution of METHOCEL by 50% with the present soil release agent resulted in such a significant decrease in cloud point. Further dilution to form a 25/75% mixture of Example 1 resin METHOCEL resulted in a similar clear/cloud point.

EXAMPLE 7

Eight 6 inch square cloth swatches (4 of 100% polyester and 4 of 50/50 cotton/polyester, (permanent press) were each scoured three times in a Sears Kenmore heavy duty washer set for hot wash and warm rinse cycles using TIDE detergent. After three washings, the swatches were dried.

A 2.5% aqueous solution of 95% vinyl-e-caprolactam/5% dimethylamino ethyl methacrylate copolymer resin was used to pad each of 4 dried polyester and 4 dried 50/50 cotton/polyester swatch. The swatches were dipped three times into a glass beaker containing the copolymer solution. Each swatch was then removed and the excess liquid was allowed to drip off the cloth for about 10 seconds after which the swatches were padded by passing them through rollers to squeeze out excess liquid. The weight of each swatch was recorded before and after padding to determine the amount of resin picked up by the cloth. The resin pick-up reported on the following table represents a 4 replicate average. Another 8 swatches cut from the same materials were dipped only in water and also padded. These swatches served as controls.

All 16 swatches were dried for 2 hours at 85°-90° C. in an oven with air circulation and then equilibrated at ambient temperature for 22 hours. Each swatch was then stretched and fastened with an elastic band over the top of a 400 ml glass beaker and 2 drops of dirty motor oil (10 W 40 Quaker State, ~5000 miles used in a 4 cylinder auto engine) were placed in the center of the cloth and allowed to wick for 2 hours. The cloth swatches were measured for reflectance, then washed once under the above conditions and dried in a tumble type drier, after which the swatches were remeasured for reflectance and the difference in the amount of reflectance, i.e. ΔRdf, is reported in the following table. The ΔRdf reported represents a 4 replicate average. The higher the ΔRdf, the more complete the soil release.

TABLE

| | Efficiency of Soil Removal | | |
|---|---|---|---|
| | Resin Pick-Up - % | 95% VCPL/5% DMAEMA at 2.5% aqueous solution Δ Rdf | Control-water only Δ Rdf |
| 100% polyester | 2.63% | 20.01 | 6.35 |
| 50/50 cotton/polyester (perm. press) | 2.07% | 14.83 | 12.33 |

What is claimed is:

1. A product comprising a textile fiber having coated thereon an effective soil releasing amount of a N-vinyl caprolactam soil releasing agent selected from the group of N-vinyl caprolactam homopolymers, copolymers and terpolymers, each copolymer and terpolymer being predominantly N-vinyl caprolactam with a minor amount of at least one monomer selected from the group consisting of (1) N-vinyl-pyrrolidone, (2) dialkylaminoalkyl acrylamide, (3) dialkylaminoalkyl methacrylamide, (4) dialkylaminoalkyl acrylate, (5) dialkylaminoalkyl methacrylate, (6) dialkyl dialkenyl ammonium halide, (7) stearyl acrylate and (8) stearyl methacrylate; and a blend of one or more of said N-vinyl caprolactam polymers with a conventional, supplementary anti-soiling agent.

2. The product of claim 1 wherein the fiber is in the form of a fabric.

3. The product of claim 2 wherein the fabric contains polyester fibers.

4. The product of claim 1 wherein the supplementary anti-soiling agent is selected from the group of a cellulose ether, a hydroxylated polyurethane, a polycarboxylate polymer, a vinylidene ester/unsaturated acid or anhydride copolymer and a fluorocarbon polymer.

5. The product of claim 1 wherein the N-vinyl caprolactam soil releasing agent is a blend of vinylcaprolactam resin and a hydroxyalkyl alkyl cellulose ether combined in a weight ratio of between about 60:40 and about 40:60.

6. The product of claim 5 wherein the hydroxyalkyl alkyl cellulose ether is hydroxypropyl methyl cellulose ether.

7. A textile soil release composition comprising an aqueous solution containing an effective soil releasing amount of a soil releasing agent of N-vinyl caprolactam resin selected from the group of N-vinyl caprolactam homopolymers, copolymers and terpolymers, each copolymer and terpolymer each copolymer and terpolymer being predominantly N-vinyl caprolactam with a minor amount of at least one monomer selected from the group consisting of (1) N-vinyl pyrrolidone, (2) dialkylaminoalkyl acrylamide, (3) dialkylaminoalkyl methacrylamide, (4) dialkylaminoalkyl acrylate (5) dialkylaminoalkyl methacrylate, (6) dialkyl dialkenyl ammonium halide, (7) stearyl acrylate and (8) stearyl methacrylate; and a blend of one or more of said N-vinyl caprolactam polymers with a conventional, supplementary anti-soiling agent.

8. The composition of claim 7 wherein the aqueous solution contains from about 0.1 to about 15 weight percent of said soil releasing agent.

9. The composition of claim 8 wherein said soil releasing agent is a resin consisting essentially of between about 65 and about 100% weight percent N-vinyl caprolactam; between about 0 and about 35 weight percent N-vinylpyrrolidone; and between about 0 and about 10 weight percent dialkylaminoalkyl methacrylate optionally blended with between about 40 and about 60 weight percent of a hydroxylated alkyl cellulose ether.

* * * * *